United States Patent [19]

Cross

[11] Patent Number: 4,731,143

[45] Date of Patent: Mar. 15, 1988

[54] PROCESS OF TRANSFERRING A LATEX FILM ONTO A SUBSTRATE

[75] Inventor: Jimmy D. Cross, Signal Mountain, Tenn.

[73] Assignee: Polysar Financial Services, S.A., Fribourg, Switzerland

[21] Appl. No.: 875,446

[22] Filed: Jun. 17, 1986

[51] Int. Cl.[4] ..... B32B 25/10; B32B 25/12; B32B 25/14; B32B 31/30

[52] U.S. Cl. ..... 156/231; 156/238; 156/246; 156/344; 156/540; 156/555; 156/583.1; 264/171; 264/257; 264/321; 264/324; 425/373; 427/179; 427/389.9; 524/552; 524/556; 524/572; 524/575

[58] Field of Search ..... 264/46.2, 46.3, 134, 264/166, 171, 321, 324, 257; 425/373; 156/231, 246, 247, 238, 344, 390, 540, 555, 583.1; 427/179, 389.9, 394; 524/552, 556, 560, 563, 566, 572, 575

[56] References Cited

U.S. PATENT DOCUMENTS

| | | | |
|---|---|---|---|
| 3,163,689 | 12/1964 | Ives | 264/134 X |
| 3,409,569 | 11/1968 | Lane et al. | 524/552 X |
| 3,505,156 | 4/1970 | Handscomb et al. | 427/389.9 X |
| 3,620,872 | 11/1971 | Blackwell | 156/231 |
| 3,630,802 | 12/1971 | Dettling | 156/231 |
| 3,957,940 | 5/1976 | Schubert et al. | 264/171 |
| 3,970,629 | 7/1976 | Izaki et al. | 524/556 X |
| 3,978,178 | 8/1976 | Oshima et al. | 264/166 X |
| 4,036,675 | 7/1977 | Amberg et al. | 264/321 X |
| 4,051,214 | 9/1977 | Casper et al. | 264/137 |
| 4,051,215 | 9/1977 | Tsuruta et al. | 264/137 |
| 4,098,944 | 7/1978 | Pollock | 428/284 |
| 4,316,934 | 2/1982 | Maier et al. | 264/321 X |
| 4,462,852 | 7/1984 | Custor | 156/231 |

OTHER PUBLICATIONS

Kirk-Othmer Encyclopedia of Chemical Technology, vol. 6, pp. 377–411.

*Primary Examiner*—Jeffery Thurlow
*Assistant Examiner*—Leo B. Tentoni
*Attorney, Agent, or Firm*—Stevens, Davis, Miller & Mosher

[57] ABSTRACT

A thin tough glossy surface may be applied to a flexible substrate in a one step process comprising: applying an aqueous thin film of a compound of a polymer to an endless carrier belt made of a material having a low adhesion to said polymer, contacting the flexible substrate and coated carrier belt and keeping them together while they pass around a hot drum laminator at a temperature of from about 100° to about 150° C.

The process is suitable for applying impermeable surfaces to non wovens, and foam backed carpet.

5 Claims, 1 Drawing Figure

PROCESS OF TRANSFERRING A LATEX FILM ONTO A SUBSTRATE

BACKGROUND OF THE INVENTION

The present invention relates to a process for continuously transferring, bonding and drying a film of a compound of an aqueous dispersion of a polymeric binder to a flexible substrate.

Surface laminated polymeric compounds are used in a wide range of applications. These compounds provide a tough shiny protective surface which may be impermeable. These coatings are useful as protective carrier coatings for foams and as protective backing coating for foam backed carpet. The coatings are also useful to provide a "skin" on non wovens which protect the non woven. These backed textiles are useful in a number of applications such as diapers, geotextiles and vapour barriers on insulation batts.

In the foam rubber industry there has been a desire to produce a rubber foam with the surface qualities of urethane foam. Preferably the foam should have a tough shiny surface. One approach to this problem is disclosed in U.S. Pat. No. 4,098,944 issued July 4, 1978 to Borg Warner Corp. This patent teaches spray coating the back of a carpet with from about 20 to 90 g/yd$^2$ of a compound comprising 5 to 100 parts by weight of a latex of a carboxylated styrene butadiene rubber (X-SBR) and 100 parts of a hydrocarbon wax. The application of a "skin" to the back of a foam backed carpet has not been widely accepted in the carpet industry. It is difficult to get low coat weights for the surface finish and the surface tends to have an orange peel appearance rather than a smooth glossy appearance. The surface appearance of the foam has a strong influence on consumer selection of product.

Non wovens are a rapidly growing market in North America. In many cases it is desirable to apply a barrier coat to the surface of the non woven. This may be done by laminating or calendering a preformed sheet to the non woven web.

The Kirk Othmer Encyclopedia of Chemical Technology, John Wiley and Sons, New York, 1979, Vol. 6 at pages 377 through 411, discussed coated textiles and coating processes. Precast coating is known to be used with textiles and non wovens. In the process one or more coatings is applied to a flexible metal sheet which is contacted with the surface of the substrate to be coated. The present invention combines cast coating with drum lamination techniques to apply, bond, and dry a wet coating to a substrate in a simple efficient manner.

SUMMARY OF THE INVENTION

The present invention provides a one step process for producing a film from about 0.001 to 0.05 inches in thickness on a flexible surface selected from the group non wovens and foam backed carpet of a compound of an aqueous dispersion of a polymer binder comprising:

(a) applying a thin film of said compound to an endless carrier belt having a low adhesion to said polymeric binder, made of a material selected from the group consisting of $C_{2-3}$ poly olefins, $C_{2-3}$ poly olefin terepthalate resin, poly vinyl chloride, and poly vinylidene chloride (b) contacting said flexible substrate and coated carrier belt and maintaining them in relative position while passing them around at least a portion of the surface of a hot drum laminator at a temperature from about 100° to about 150° C. to dry said compound and transfer it to said substrate; and (c) delaminating said carrier belt from said substrate.

The present invention also provides in a hot drum laminator the improvement comprising the following elements in a cooperating arrangement:

(i) an endless carrier belt passing at least partially around the circumference of said hot drum and being in direct contact with the surface of said drum;

(ii) coating means cooperating to coat said carrier belt with a compound of an aqueous dispersion of a polymeric binder; and (iii) guide rolls to guide said carrier belt from said hot drum to said coating means.

DETAILED DESCRIPTION OF THE INVENTION

Figure 1:
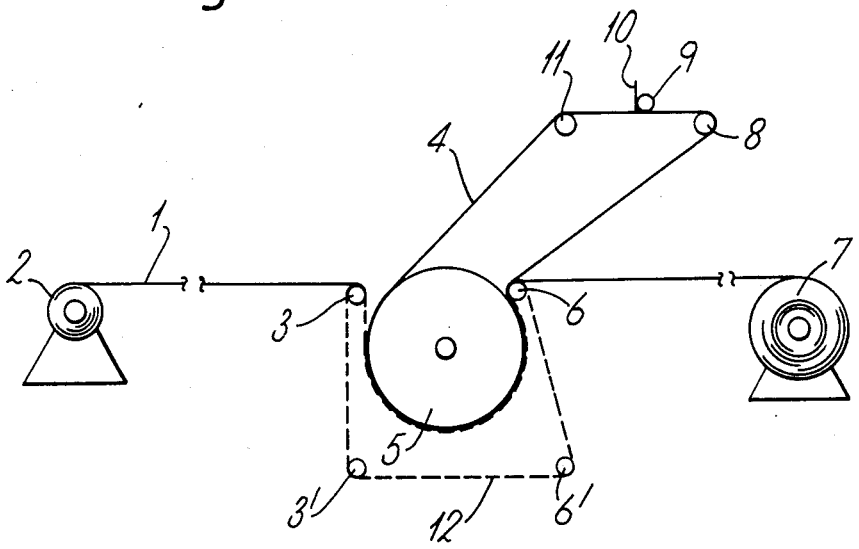

The process of the present invention is practiced using a hot drum laminator.

FIG. 1 is a sketch of a suitable apparatus.

In the process the substrate 1 is provided from a suitable source such as an unwind stand 2. In some instances it may be desirable to feed the substrate directly from its manufacture process to the process of the present invention. The substrate passes over guide roll 3 and comes into contact with carrier belt 4 which is coated with a compound of a dispersion of a polymeric binder. The substrate, coating and carrier belt 4 pass at least partially around the circumference of a hot laminator drum 5 to apply, bond and dry the compound. The now coated substrate and the carrier belt 4 pass over guide roll 6. At this point the carrier belt delaminates from the substrate. The substrate may then be subject to further treatment such as coating its opposite surface using the same procedure. The substrate is then finished typically by rolling on a windup stand 7. In some cases for carpets the carpet may be directly cut to form suitable sized carpet tiles.

The carrier belt proceeds from guide roll 6 to guide roll 8 where it changes direction and passes through a suitable coating apparatus. In the drawing, the coating apparatus comprises a puddle of compound 9 and a blade coater 10. The present invention is not intended to be limited to this coating means and extends to any suitable coating method including gravure coaters, roller coaters, kiss coaters, Meyer rods, and air knife coaters. The coated carrier belt passes over guide roll 11 and changes direction to proceed to guide roll 3 where it comes in contact with the substrate.

In an optional embodiment the drum laminator may be used in conjunction with a tension belt or web 12 which travels over guide rolls 6, 6'3' and 3 and partly around the circumference of drum laminator 5.

The substrate may be a number of materials including foam rubber or foamed urethane, foam backed carpet and non wovens. When a foam backed carpet is the substrate it is fed to the process "green side up" (i.e. with the foam backing being exposed to the carrier belt).

There are many types of non wovens which may be used as substrates in accordance with the present invention. The non woven may be made of hydrophylic fibers such as natural fibers including cotton, jute, flax wool, cellulose, reconstituted cellulose such as rayon, or synthetic fiber such as polyamides such as nylon 6 or nylon 66. The fibers may be hydrophobic such as $C_{2-3}$ polyolefins, and polyesters. The non woven may be a blend of both hydrophobic and hydophylic fibers in all weight ratios from 100:0 to 0:100 preferably 25:75 to 75:25. In the fiber industry hydrophobic fibers are defined as those fibers which will have a moisture regain of less than 2.5 percent at 70° C. and 65 percent relative humidity. Generally such fibers include polyolefins and polyesters. The present invention may also be used in association with glass or mineral fibers to provide a vapour barrier on the back of a friction fiber batts of insulation.

Non wovens are generally relatively lightweight materials having a weight from about 5 to 130 g/yd$^2$. The density for fiber insulation batts is generally from about 5 to 12, preferably 5 to 10 pounds per cubic foot. For insulation foams such as foamed polystyrene, foamed isocyanate backed material and foamed urethanes the density is in the range of 2 to 5 preferably 2 to 3 pounds per cubic foot.

The rate of travel of the substrate through the process will depend on a number of factors including the diameter size of the drum, viscosity of the compound, the coat weight of compound to be applied, and the temperature of the hot drum in the laminator. It will be desirable to adjust line speed with one or more of the above variables to achieve proper coating. The line speed, under typical conditions may be up to about 90 to 100 feet per minute. Preferably the line speed will be from about 30 to 50 feet per minute. The hot drum laminator may be operated at temperatures up to about 200° C. typically 80° to 180° C., most preferably about 100° to 150° C.

The carrier belt, in accordance with the present invention is preferably a sheet of a thermoplastic polymer. Suitable polymers include poly $C_{2-3}$ olefins; resins of $C_{2-3}$ alpha olefins and terephthalate esters such as Mylar (trademark) and homopolymers of vinyl chloride or vinylidene chloride and webs of glass fibers. Generally the transfer web is in the form of a very thin sheet from about 0.003 to 0.008 preferably about 0.005 inches thick The carrier belt is in the form of an endless belt passing through the coating means 10 and over the guide rolls 3 and 6 and around the laminating drum 5. The web may, if desired, have a textured surface. In the alternative the drum may be textured and the carrier belt smooth. Since the carrier belt forms an endless belt the material it is selected from must be capable of withstanding multiple heating cycles and some abrasion resistance.

The compound of an aqueous dispersion of a polymeric binder will typically comprise an aqueous dispersion of a polymeric binder, optionally a filler and usually a release agent. The solids content of a filled compound may be up to about 85 percent by weight, preferably in the 60 to 75 weight percent range. The filler may be any filler compatible with the process. Typical fillers include particulate mineral fillers such as clay, calcium carbonate, calcium silicate, hydrated alumina, hydrate alumina silicate, and chalk. The filler may be used in amounts up to about 80, preferably not more than 60 parts by weight per 100 parts by dry weight polymer.

The release agent, if required, is used in amounts less than about 10, preferably less than 3 parts by weight per 100 parts by weight of polymer. There are a number of commercially available release agents. Some of these are listed in Functional Materials published annually by the McCutcheon Division of MC Publishing Co. Suitable release agents include low molecular weight (i.e. less than 100 $C_{2-4}$ alkylene glycols; low molecular weight poly $C_{2-4}$ olefins, silicon emulsions, organosilicones, surfactants preferably fatty acids or amines or amidoamines and waxes. A particularly useful class of release agents are sold by Diamond Shamrock under the trademark NOPCO 1186.

The aqueous dispersions of the polymeric binder are commercially available. Generally, these dispersions contain up to about 75 weight percent, preferably 50 to 68 weight percent of polymeric solids. There are a number of polymers which may be used in accordance with the present invention.

The polymer may be a homopolymer of a $C_{4-6}$ conjugated diolefin which is unsubstituted or substituted by a chlorine atom. Representative of such polymers are natural rubber and chloroprene.

The polymer may be styrene butadiene rubber (SBR) or a functional, preferably carboxylated, styrene butadiene rubber (X-SBR). Generally these polymers comprise:

20 to 80, preferably 40 to 60 weight percent of a $C_{8-12}$ vinyl aromatic monomer which may be unsubstituted or substituted by a $C_{1-4}$ alkyl radical or a chlorine or bromine atom;

80 to 20, preferably 60 to 40, weight percent of a $C_{4-6}$ aliphatic diolefin and 0 to 10, preferably less than 5, weight percent of one or more monomers selected from the group consisting of:

$C_{3-6}$ ethylenically unsaturated carboxylic acid;

amides of $C_{3-6}$ ethylenically unsaturated carboxylic aicds which amides may be unsubstituted or substituted at the nitrogen atom by up to two radicals selected from the group consisting of $C_{1-4}$ alkyl radicals and $C_{1-4}$ hydroxy alkyl radicals;

$C_{1-6}$ alkyl and hydroxy alkyl esters of $C_{3-6}$ ethylenically unsubstituted carboxylic acids; and $C_{3-6}$ ethylenically unsubstituted aldehydes.

The polymer may be an acrylate. Typically such polymers comprise:

60 to 99.5 preferably 70 to 99.5 weight percent of a $C_{1-4}$ alkyl or hydroxy alkyl ester of acrylic or methacrylic acid;

up to 40, preferably less than 30, weight percent of one or more monomers selected from the group consisting of $C_{8-12}$ vinyl aromatic monomers which may be unsubstituted or substituted by a $C_{1-4}$ alkyl radical or a chlorine or bromine atom; $C_{3-6}$ alkenyl nitriles; vinyl chloride, and vinylidene chloride;

0 to 10 weight percent, preferably less than 5 weight percent of one or more monomers selected from the group consisting of:

$C_{3-6}$ ethylenically unsaturated carboxylic acids;

amides of $C_{3-6}$ ethylenically unsaturated carboxylic acids which amides may be unsubstituted or substituted at the nitrogen atom by up to two radicals selected from the group consisting of $C_{1-4}$ alkyl radicals and $C_{1-4}$ hydroxy alkyl radicals;

$C_{1-6}$ alkyl and hydroxyl alkyl esters of $C_{3-6}$ ethylenically unsaturated carboxylic acids, and $C_{3-6}$ ethylenically unsaturated aldehydes.

The polymer may be a copolymer of a $C_{2-3}$ olefin and a vinyl or allyl ester of a saturated carboxylic acid such as vinyl acetate or an alkyl ester of an unsaturated carboxylic acid such as butyl acrylate. Such polymers may optionally contain a functional monomer.

Typically such polymers comprise:

from 5 to 25, preferably 5 to 15, weight percent of $C_{2-3}$ efin and from 95 to 75, preferably 95 to 85, weight percent of a monomer selected from the group consisting of:

vinyl or allyl esters of $C_{1-8}$ saturated carboxylic acids;

$C_{1-4}$ alkyl or hydroxy alkyl esters of $C_{3-6}$ ethylenically unsaturated carboxylic acids; and from 0 to 10, preferably less than 5, weight percent of one or more monomers selected from the group consisting of:

$C_{3-6}$ ethylenically unsaturated carboxylic acids;

amides of $C_{3-6}$ ethylenically unsaturated carboxylic acids, which amides may be unsubstituted or substituted at the nitrogen atom by a $C_{1-4}$ alkyl or hydroxy alkyl radical;

$C_{1-6}$ alkyl or hydroxy alkyl esters of $C_{3-6}$ ethylenically unsaturated carboxylic acids; and $C_{3-6}$ ethylenically unsaturated aldehydes.

Suitable $C_{8-12}$ vinyl aromatic monomers useful in accordance with the present invention include, styrene, alpha methyl styrene, and chlorostyrene.

Suitable $C_{4-6}$ aliphatic diolefins include butadiene, isoprene, and chloroprene.

Suitable $C_{3-6}$ ethylenically unsaturated carboxylic acid monomers include acrylic acid, methacrylic acid, fumaric acid and itaconic acid.

Suitable amides of $C_{3-6}$ ethylenically unsaturated carboxylic acids include acrylamide, methacrylamide, N-methylol acrylamide, N-methylol methacrylamide.

Suitable $C_{3-6}$ ethylenically unsaturated aldehydes include acrolein.

Suitable esters of acrylic and methacrylic acid include methyl acrylate, ethyl acrylate, butyl acrylate, methyl methacrylate, methyl acrylate, butyl acrylate and hydroxy ethyl acrylate.

The preferred $C_{3-6}$ alkenyl nitrile is acrylonitrile.

Suitable $C_{1-6}$ alkyl and hydroxy alkyl esters of $C_{3-6}$ ethylenically unsaturated carboxylic acids include the $C_{1-4}$ alkyl and hydroxy alkyl esters of acrylic and methacrylic acid and the lower alkyl half ester of itaconic and fumaric acid and the higher alkyl ester of acrylic and methacrylic acid.

Suitable $C_{2-3}$ olefins are ethylene and propylene.

Suitable vinyl and allyl esters of $C_{1-8}$ saturated carboxylic acids include vinyl acetate, vinyl propionate, vinyl butanate, and allyl acetate.

The compound is applied to the carrier belt by a suitable means. Typically the compound will be applied to the carrier belt at a wet thickness up to about 20 mils (0.020 inches) preferably from about 5 to 15, most preferably 8 to 2 mils. The dry thickness of the skin on the substrate will be thinner by the amount of water lost from the compound when it is dried. Thus, a compound with 50 percent solids applied to the carrier belt at 10 mils wet should give about 5 mil film on the substrate. For higher filled compounds thick wet films may be used. For practical purposes the wet film may be about 120 mils thick.

The following examples are intended to illustrate the present invention and are not intended to limit it. Unless otherwise stated parts are parts by dry weight.

A compound was prepared in accordance with the following fomulations.

| Ingredient | Dry Weight | |
|---|---|---|
| | Compound A | Compound B |
| Carboxylated S-B latex (approx. 50% solids) | 100.0 | 100.0 |
| POLYSAR 2400 Release Agent | 4.0 | 4.0 |
| NOPCO-1186 Filler (calcium carbonate) | Nil | 50 |

-continued

| Ingredient | Dry Weight | |
|---|---|---|
| | Compound A | Compound B |
| Water to 55% solids | 0 | 50 |

A foam backed carpet was fed through a drum laminator adapted with a carrier belt in accordance with the present invention. Compound A was applied to the carrier belt at a wet coat thickness of 10 mils. The line speed was 35 feet per minutes and the temperature of the drum was 180° C. The product is a foam backed carpet with a shiny smooth integrated bonded film on the back of the foam. The surface does not delaminate from the foam. The bond strength between the film and foam is greater than the internal strength of the foam. The film forms a protective barrier and the backing is not easily torn or scuffed by picking at or scratching it with the fingernails of the thumb or fingers.

A series of non woven webs made of cellulose, fibers, fiberglass, polyesters, polyamides, polyolefins (Mylar) were treated in the same manner as the carpet except that compound B was the coat compound and it was applied to the carrier belt at a wet coat thickness from 1 to 20 mils. The resulting non wovens had a glossy smooth integrally bonded surface on the side which was treated. The surface did not delaminate and resisted picking:

What is claimed is:

1. A continuous process for producing a film having a thickness from 0,001 to 0.05 inches from an aqueous compound comprising per 100 parts by dry weight of a latex containing from 50 to 75 weight % of a rubbery polymer comprising:

(i) a homopolymer of $C_{4-6}$ aliphatic diolefins which may be unsubstituted or substituted by a chlorine atom;

(ii) copolymers comprising (a) 20 to 80 weight percent of a $C_{8-12}$ vinyl aromatic monomer which may be unsubstituted or substituted by a $C_{1-4}$ alkyl radical or a chlorine or bromine atoms;

(b) 80 to 20 weight percent of a $C_{4-6}$ aliphatic diolefin; and (c) 0 to 10 weight percent of one or more monomers selected from the group consisting of:

$C_{3-6}$ ethylenically unsaturated carboxylic acids amides of $C_{3-6}$ ethylenically unsaturated carboxylic acids which amides may be unsubstituted or substituted at the nitrogen atom by up to two radicals selected from the group consisting of $C_{1-4}$ alkyl radicals and $C_{1-4}$ hydroxy alkyl radicals;

$C_{1-6}$ alkyl and hydroxy alkyl esters of $C_{3-6}$ ethylenically unsaturated carboxylic acids; and $C_{3-6}$ ethylenically unsaturated aldehydes; and (iii) copolymers comprising (a) 60–99.5 weight percent of a $C_{1-4}$ alkyl or hydroxy alkyl ester of acrylic or methacrylic acid, (b) up to 40 weight percent of one or more monomers selected from the group consisting of $C_{8-12}$ vinyl aromatic monomers which may be unsubstituted or substituted by a $C_{1-4}$ alkyl radical or a chlorine or bromine atom; $C_{3-6}$ alkenyl nitriles, vinyl chloride, and vinylidene chloride; and (c) 0 to 10 weight percent of one or more monomers selected from the group consisting of:

$C_{3-6}$ ethylenically unsaturated carboxylic acids amides of $C_{3-6}$ ethylenically unsaturated carboxylic acids which amides may be unsubstituted or substituted at the nitrogen atom by up to two radicals selected from the group consisting of $C_{1-4}$ alkyl radicals and $C_{1-4}$ hydroxy alkyl radicals;

$C_{1-6}$ alkyl and hydroxy alkyl esters of $C_{3-6}$ ethylenically unsaturated carboxylic acids; and $C_{3-6}$ ethylenically unsaturated aldehydes;

up to 80 parts by weight of a filler; on a surface of a flexible web substrate selected from the group consisting of webs of nonwoven natural or synthetic organic fibers having a weight of from 5 to 130 g/yd$^2$; batts of glass fibers having a density of from 5 to 12 lb/ft$^3$; and foamed backed carpet; which comprises:

(a) applying a thin film of said aqueous compound to an endless carrier belt made of a material selected from the group consisting of $C_{2-3}$ polyolefins, $C_{2-3}$ polyolefin terephthalate resin, polyvinyl chloride and polyvinylidene chloride;

(b) contacting said web and said coated carrier belt without drying said compound to bring said wet compound into direct contact with said web and maintaining them in relative position while passing them around at least a portion of the surface of a hot drum laminator at a temperature from 100° to 150° C. to dry said compound and transfer it to said substrate to produce a flexible web having a smooth-surfaced film strongly bonded thereto; and (c) delaminating said web from said carrier belt.

2. A process according to claim 1 wherein said flexible substrate comprises a foam backed carpet and said polymeric binder comprises (a) from about 40 to 60 weight percent of a monomer selected from the group consisting of styrene, alpha methyl styrene, or a mixture thereof;

(b) from about 60 to 40 weight percent of butadiene, isoprene or a mixture thereof; and (c) up to about 5 weight percent of one or more monomers selected from the group consisting of: acrylic acid, methacrylic acid, itaconic acid, methyl acrylate, methyl methacrylate, ethyl acrylate, ethyl methacrylate, hydroxy ethyl acrylate, hydroxy ethyl methacrylate, butyl acrylate, butyl methacrylate, N-methylol acrylamide, N-methylol methacrylamide, and acrolein.

3. A process according to claim 2 wherein said flexible substrate comprises a non woven web having a weight from about 5 to 130 g/yd$^2$ and said polymeric binder comprises (a) from about 40 to 60 weight percent of a monomer selected from the group consisting of styrene, alpha methyl styrene, or a mixture thereof;

(b) from about 60 to 40 weight percent of butadiene, isoprene or a mixture thereof; and (c) up to about 5 weight percent of one or more monomers selected from the group consisting of: acrylic acid, methacrylic acid, itaconic acid, methyl acrylate, methyl methacrylate, ethyl acrylate, ethyl methacrylate, hydroxy ethyl acrylate, hydroxy ethyl methacrylate, butyl acrylate, butyl methacrylate, N-methylol acrylamide, N-methylol methacrylamide, and acrolein.

4. A process according to claim 3 wherein said non woven web has a weight from about 10 to 25 g/yd$^2$ and is made of one or more fibers selected from the group consisting of:

cotton, viscose, polyester, polyamide, polyolefin, acrylic, jute, flax and wool.

5. A process according to claim 3 wherein said non woven web has a density of from 5 to 12 pounds per cubic feet and is made of glass.

* * * * *